US005340172A

United States Patent [19]

Sweet

[11] Patent Number: 5,340,172

[45] Date of Patent: Aug. 23, 1994

[54] DOOR SECURITY SYSTEM

[76] Inventor: Lloyd Sweet, 14400 SW. 84th Ct., Miami, Fla. 33158

[21] Appl. No.: 122,926

[22] Filed: Sep. 17, 1993

[51] Int. Cl.[5] ..... E05C 19/18

[52] U.S. Cl. ..... 292/259 R; 292/338

[58] Field of Search ..... 292/262, 259, 276, 338, 292/339

[56] References Cited

U.S. PATENT DOCUMENTS

| | | | |
|---|---|---|---|
| 1,528,834 | 3/1925 | Leist-Wettler | 292/262 |
| 3,600,026 | 8/1971 | Savio | 292/276 |
| 3,955,841 | 5/1976 | Walker | 292/259 R |
| 3,980,328 | 9/1976 | Pearson | 292/259 R X |
| 3,986,741 | 10/1976 | Giovannini | 292/259 R |
| 4,852,921 | 8/1989 | Gilbert et al. | 292/259 R |
| 4,858,972 | 8/1989 | Salyer | 292/338 |

*Primary Examiner*—Rodney M. Lindsey

*Attorney, Agent, or Firm*—Malin, Haley, DiMaggio & Crosby

[57] ABSTRACT

A security bar system for use on both "inward" and "outward" opening doors that provides security by preventing forcible entry. The system preferably comprises an elongated, telescoping, bar arranged to extend horizontally across and adjacent to a pair of double doors. Inward opening doors are secured by mounting the security bar on opposing hinges, modified by incorporating docking ferrules into which right angle mounting dowels existing at each end of the reinforcing bar can be securely inserted, effectively barricading the doors closed. For outward opening double doors, where the hinge pins are typically located on the outside, door jamb mounting brackets in lieu of hinge mounted docking ferrules, are securely fastened to both sides of the door jamb material on the interior at approximately the same height as the door knobs. To secure outward opening doors, the security bar is mounted on the mounting brackets and equipped with an adjustable sleeve that, when properly positioned, engages both door knobs securing them to the security bar.

6 Claims, 4 Drawing Sheets

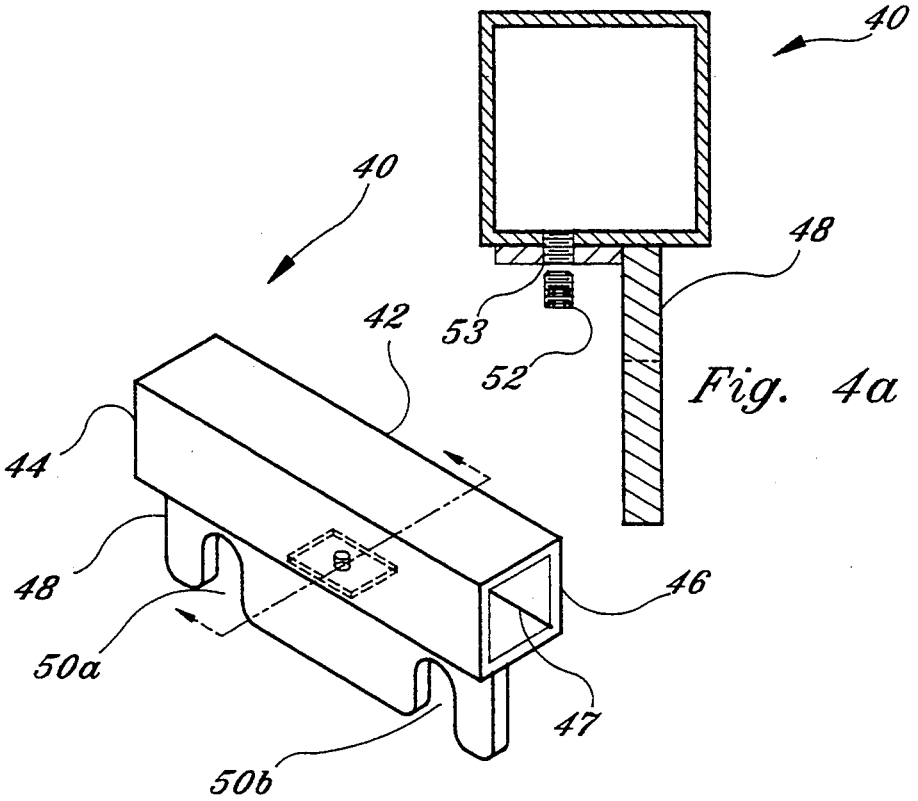
Fig. 4a
Fig. 4
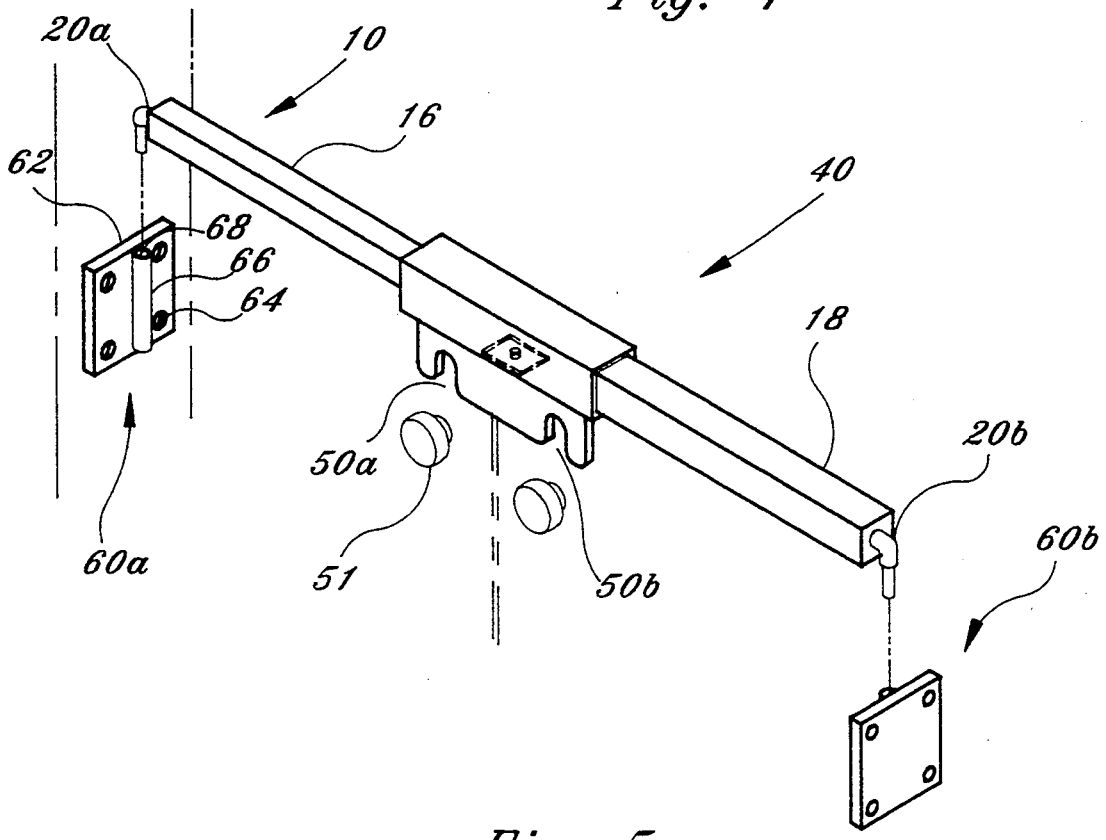
Fig. 5

DOOR SECURITY SYSTEM

BACKGROUND OF THE INVENTION

1. Field of the Invention

The present invention relates generally to a system for effectively securing conventional doors and the like. More particularly, the present invention relates to a security bar system adapted to be removably secured to opposing interior sides of a door frame on hinged, inward or outward opening, interior or exterior doors, to prevent forcible entry.

2. Description of the Prior Art

The need for a simple and effective means for providing adequate security by preventing forcible entry is well recognized in the art. To that end, a variety of security systems for barricading doors have been employed to protect those inside from both criminal as well as natural elements.

A common feature among many such systems is the use of a rigid bar for bracing doors closed. A variety of systems presently known in the art, which secure doors in this manner, have resulted in inefficient designs and complicated structures requiring an abundance of unsightly, permanently installed, hardware. Furthermore, the prior art references discovered are not readily adaptable for use in securing outward opening doors.

For example, U.S. Pat. No. 4,429,911, issued to O'-Neal, introduces a door security bar system restrained by a pair of unsightly mounting brackets that must be interiorly mounted on either side of the door. Mounting the brackets in this manner requires drilling a multitude of holes, and since the hardware cannot be easily removed, it must remain plainly visible on the wall surface in an aesthetically objectionable manner. In addition, this invention does not disclose an embodiment suitable for use with outward opening doors.

Similarly, U.S. Pat. No. 4,601,503, issued to Wicks, and U.S. Pat. 4,067,598 issued to Mansour suffer from similar flaws. The Wicks invention introduces apparatus for securing an inward opening door against forcible entry utilizing a hinged hasp-like retainer, an eye-type retainer, and a rectangular bar-like security member. The Mansour invention introduces an apparatus for securing an inward opening door utilizing an elongated latching member pivotally connected to the door jamb on one side of a door and a J-shaped clip supported by the opposite door jamb. When not in use, these inventions contemplate leaving in place an abundance of unsightly hardware permanently mounted on or adjacent to the door frame. Likewise, both of these inventions contemplate securing doors by exerting an outward force on the interior door surface, and are not embodied in a way as to retain outwardly opening doors.

U.S. Pat. No. 4,462,625, issued to Barnhill, reveals a telescoping securing member attached to an existing door hinge and selectively connecting to a latch member disposed on the framework at the opposite side of the entry. This invention contemplates pivoting the retaining member to an upwardly extending storage position where it also remains visible when not in use.

U.S. Pat. No. 3,971,100, issued to Anop, discloses a hinge mounted auxiliary lock incorporating an elongated cross bar having a plurality of adjustable stop members projecting therefrom for engaging the surface on the door and the door jamb. This invention is not adaptable to outward opening doors and is less effective as a barricade as the devise does not extend across the entire length of the door.

While the aforementioned devices disclose various designs which attempt to secure doors closed and prevent forcible entry, the prior art reveals complicated structures that utilize an abundance of hardware, are awkward to maneuver, not readily adaptable to securing outward opening doors, and permanently alter the aesthetics in an objectionable manner. This invention is intended to solve these problems that are not adequately resolved by the prior inventions.

SUMMARY OF THE INVENTION

The present invention contemplates a security bar system adapted to be removably secured to the interior door frame on opposite sides of hinged, inward or outward opening doors, to prevent forcible entry.

The system comprises a telescoping security bar that extends horizontally across a pair of double doors. For inward opening doors, the security bar is mounted on opposing hinges, existing on the inside of an exterior door frame and pivotally securing the doors to the frame in a conventional manner. The hinges are modified by replacing the existing hinge pins with adapter pins, each securing a docking ferrule into which right angle mounting dowels existing at each end of the security bar can be inserted.

To install the security bar on double doors, the right angle mounting dowel existing at one end is inserted into the docking ferrule receptacle secured to one of the previously modified hinges. The telescoping bar is then extended sufficiently to permit the opposite end to be secured by an opposing, previously modified, hinge in a similar manner, thus effectively barricading the doors closed. A set screw secures the telescoping bar at the appropriate length for a given door width.

For securing outward opening doors, in lieu of modifying the existing hinges, door jamb mounting brackets are securely fastened to opposing sides of the door jamb material on the inside, of an interior or exterior door, at approximately the same height as the door knobs. In addition, the security bar is equipped with an adjustable sleeve that, when properly positioned, engages both door knobs thereby securing them to the security bar. To install the security bar on outward opening doors, the L-shaped mounting dowel existing at one end of the bar is inserted into the receptacle existing on one of the door jamb mounting brackets. The bar is then extended sufficiently to permit the opposite end to be secured and the locking set screw is tightened. An adjustable sleeve is then positioned as to engage both door knobs. When lowered into position, the opposite end is secured in the remaining door jamb mounting bracket and the properly positioned sleeve engages the door knobs securing them to the security bar and thus retaining the doors. The sleeve also incorporates a locking set-screw that fixes the sleeve at a user selected position along the security bar when tightened.

The security bar is removed by vertically raising the bar so that the mounting dowels exit the mounting receptacles. The telescoping security bar can then be conveniently hung directly on the door jamb or casing with the use of a storage bracket, or collapsed for convenient storage leaving a minimal amount of hardware around the doors.

In accordance with the present invention, it is an object hereof to provide a door security bar system for maximizing the security of a dwelling or the like.

An additional object of the instant invention is to provide a security bar system adaptable for use on both inward and outward opening doors.

Still another object of the instant invention is to provide a system for securing doors that may be installed at minimum cost.

Still another object of the instant invention is to provide a system for securing doors that may be installed on either single or double doors.

An additional object of the instant invention is to provide a system for securing doors that requires a minimum amount permanently fixed hardware on or around the doorway.

Still another object of the instant invention is to provide a system for securing double doors that is expandable so as to secure doors of differing widths.

An additional object of the instant invention is to provide a system for securing doors that is easily removable and neatly stored.

A further object of this invention is to provide a system for securing doors that collapses for convenient out of sight storage.

In accordance with these and other objects which will become apparent hereinafter, the instant invention will now be described with particular reference to the accompanying drawings.

BRIEF DESCRIPTION OF THE DRAWINGS

FIG. 4 is a perspective view of a door knob retaining device for use on outward opening double doors.

FIG. 4*a* depicts a sectional view of the door knob retaining device detailing the set-screw configuration.

FIG. 5 is an exploded view of the security bar, including the door knob retaining device, mounted on a pair of conventional outward opening double doors.

DESCRIPTION OF THE PREFERRED EMBODIMENTS

Figure 1:
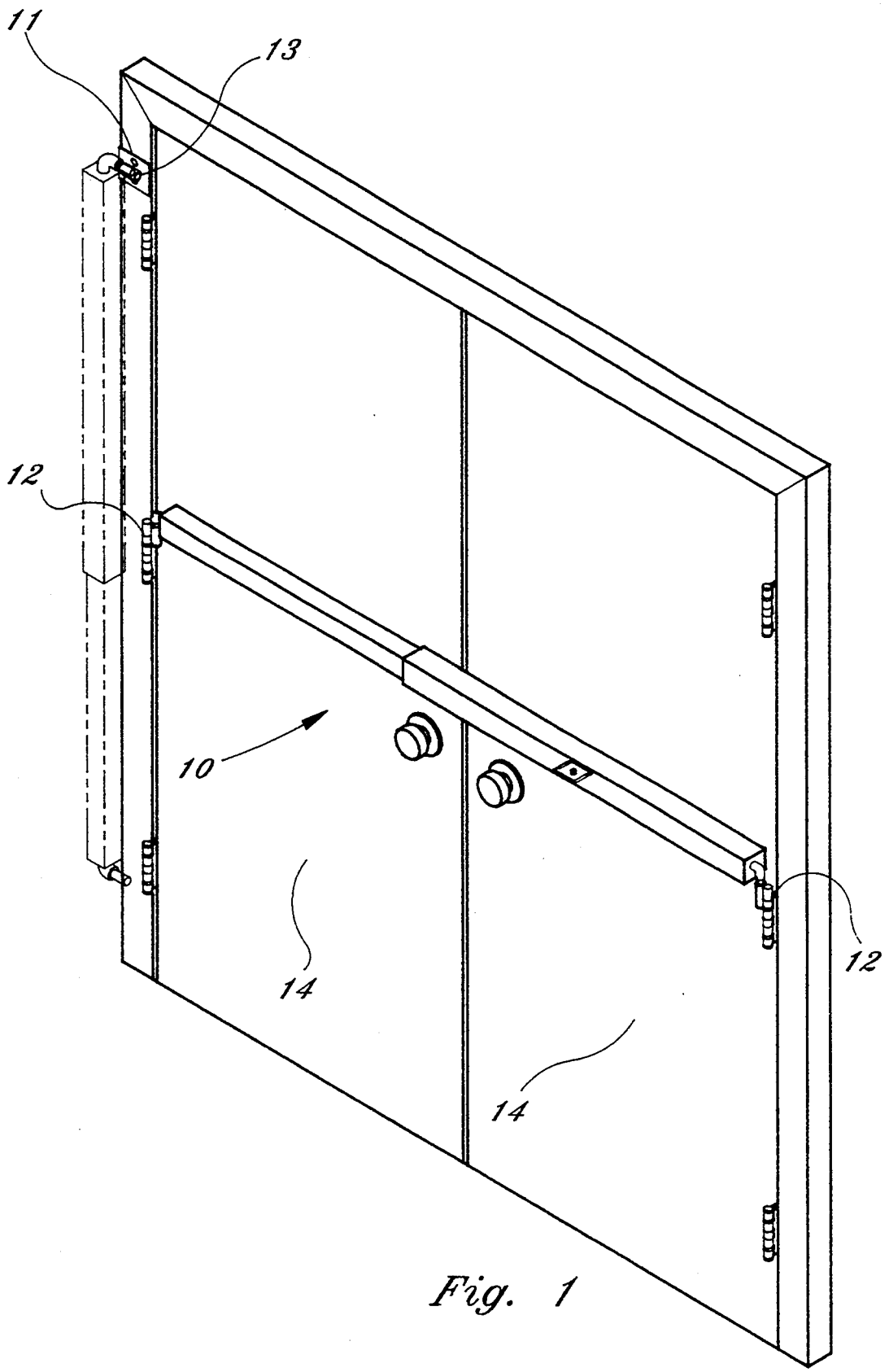
FIG. 1 is a perspective view of the security bar mounted on a pair of conventional, inward opening double doors.

With reference to FIG. 1, there is depicted a door security bar system generally designated as 10, mounted on existing hinges 12 and securing a pair of inward opening double doors 14.

Figures 2, 2A, 3:
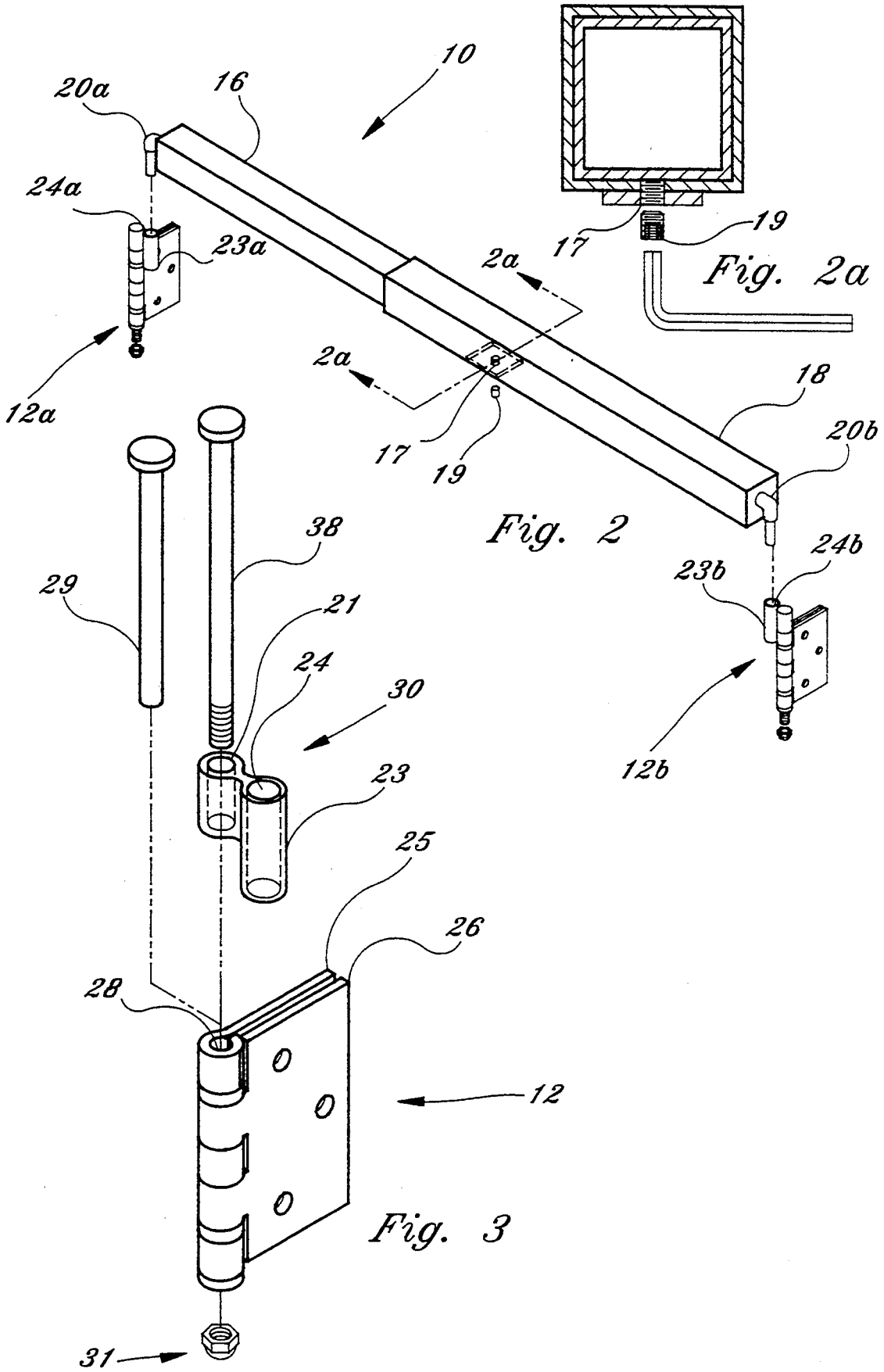
FIG. 2 is an exploded view of the security bar and hinge adapter assemblies.
FIG. 2*a* depicts a sectional view of the security bar detailing the set-screw configuration.
FIG. 3 is an exploded view detailing a modified hinge for mounting on inward opening double doors.

Turning now to FIG. 2, there is depicted and exploded view detailing the security bar 10 and hinge adapter assemblies, generally designated 12*a* and 12*b*. Reference numeral 10 depicts a security bar system adapted for use in securing doors having a first section 16, and a second section 18, movably engaged such that the security bar 10 is longitudinally expandable and contractible. Said first section 16 and said second section 18, each terminate in substantially L-shaped right angle mounting dowels 20*a* and 20*b* respectively. Further depicted are docking ferrules 23*a* and 23*b* mounted on conventional hinges 12*a* and 12*b*, said docking ferrules, each incorporating an aperture, 24*a* and 24*b* respectively, disposed therethrough. Security bar section 18 further incorporates a threaded aperture 17 and locking set-screw 19 for locking the security bar 10 at a user selected length as depicted in section view FIG. 2*a*.

With reference now to FIG. 3, there is shown an exploded detail of a modified hinge assembly generally depicted 12 having conventional hinge leafs 25 and 26 and an aperture extending therethrough 28. The present invention contemplates removing the standard hinge pin 29, and capping the existing hinge 12 with a mounting adapter generally designated as 30. Said mounting adapter 30 incorporates a first aperture 21, and a second aperture 24, both disposed vertically therethrough in parallel alignment. The mounting adapter 30 is permanently mounted on hinge 12 by aligning said first aperture 21 with the aperture 28 on the existing hinge 12, and secured, by an extended hinge pin 38, disposed through said apertures and having a length in excess of said standard hinge pin 29, as to enable the extended hinge pin 38 to properly seat in the hinge 12 thereby securing said mounting adapters 30. The extended hinge pins 38 are threaded along at least the bottom portion such that the pins 38 are secured in the hinge 12 by a conventional threaded fastener 31. Therefore, the mounting adapter 30 is pivotally secured to the existing hinge leaves 25 and 26. The modified hinge assembly 12, thus incorporates a docking ferrule 23 having an aperture 24 disposed therethrough for accepting a mounting dowel 20*a* as depicted in FIG. 2.

Turning again to FIG. 2, to secure inward opening doors, the security bar 10 is fixed in place by detachably mounting said first security bar section 16 on said modified hinge 12*a* by lowering said security bar mounting dowel 20*a* into the aperture 24*a* of said docking ferrule 23*a* existing on said modified hinge 12*a*. The security bar 10 is then longitudinally expanded such that the opposite mounting dowel 20*b* existing at the opposite end of security bar section 18 can be matingly joined in a similar manner with the aperture 24*b* of said docking ferrule 23*b* existing on said second modified hinge 12*b*. Said locking set screw 19 is tightened thereby anchoring the security bar sections 16 and 18 relative to each other thus fixing the length of the security bar 10 and facilitating installation and removal. Turning now to FIG. 1, the door security bar 10 remains rigidly secured adjacent to said doors 14, extending across the doorway and serving as an effective barricade thus preventing forcible entry.

Additional security may be derived by repeating the described installation procedure for the remaining sets of hinges thus enabling the use of multiple security bars in parallel arrangement. A storage bracket 11 having a docking ferrule 13 disposed horizontally thereon, and mounted on the door jamb material with conventional fasteners, allows the security bar 10 to hang unobtrusively to the side of the door jamb when not in use, as depicted in FIG. 1.

Outward opening doors are secured in an alternate embodiment by utilizing an adjustable door knob retaining slide bar generally designated as 40 in FIG. 4. Said door knob retaining bar comprises an elongated retaining member 42, having a first end 44 and a second end 46, and having an aperture 47 extending therethrough. Said door knob retaining member 40, further incorporates a flange 48 extending vertically downward and incorporating a pair of parabolic notches 50*a* and 50*b* respectively, also disposed vertically downward, so that said flange 48 demountably couples said door knobs when lowered, thereby securely retaining them adjacent to said retaining bar 42. Said door knob retaining member 40 further incorporates a locking set screw 52 disposed within a threaded aperture 53 in said door knob retaining member 40 as depicted in section view FIG. 4*a*, for locking said retaining member in place at a user selected position along said security bar 10.

Said aperture 47 of said door knob retaining member 40, is of sufficient dimension as to accommodate said double door security bar 10 disposed therein as depicted in FIG. 5, such that said retaining member 40 is slidable along a portion of the length of said security bar 10, thus enabling a user to position said retaining member 40 at a position along said security bar 10 for properly engaging door knobs 51 and securely retaining said door knobs adjacent to said security bar 10.

Since the hinge pins for outward opening doors are generally not accessible from the interior, this invention contemplates an alternate mounting method than that described for inward opening doors. Turning again to FIG. 5, in this embodiment, outward opening double doors are secured by fixing door jamb mounting brackets, generally designated as 60*a* and 60*b*, in opposing positions on either side of the inside door jamb material at approximately the same height as the existing door knobs 51.

With reference now to door jamb mounting bracket 60*a*, each door jamb mounting bracket incorporates a base plate 62, having a plurality of generally circular apertures 64, through which conventional fasteners rigidly fix said mounting brackets 60*a* and 60*b* to the door jamb material. Each door jamb mounting bracket 60*a* and 60*b* further incorporate a generally cylindrical docking ferrule 66, rigidly fixed, as by welding, to said base plate 62, and having and aperture 68 extending vertically therethrough.

To secure outward opening double doors, the security bar 10 is fixed in place by detachably mounting said first security bar section 16 on said mounting bracket 60*a* by lowering said security bar retaining dowel 20*a* into the aperture 68 of said docking ferrule 66. The security bar 10 is then longitudinally expanded such that the opposite mounting dowel 20*b* existing at the opposite end of bar section 18 is aligned with the docking ferrule existing on mounting bracket 60*b* and said locking set-screw 19 is tightened. The door knob retaining bar 40, having said security bar 10 disposed therethrough, is slidably positioned as to properly engage said door knobs 51 when lowered. Finally, the entire security bar assembly 10 is lowered into place such that mounting dowel 20*b* is secured by bracket 60*b*, and flange 48 engages the door knobs 51. The door knob retaining bar 40 is then locked into position along said security bar 10 by tightening the second locking set-screw 52.

Figure 6:
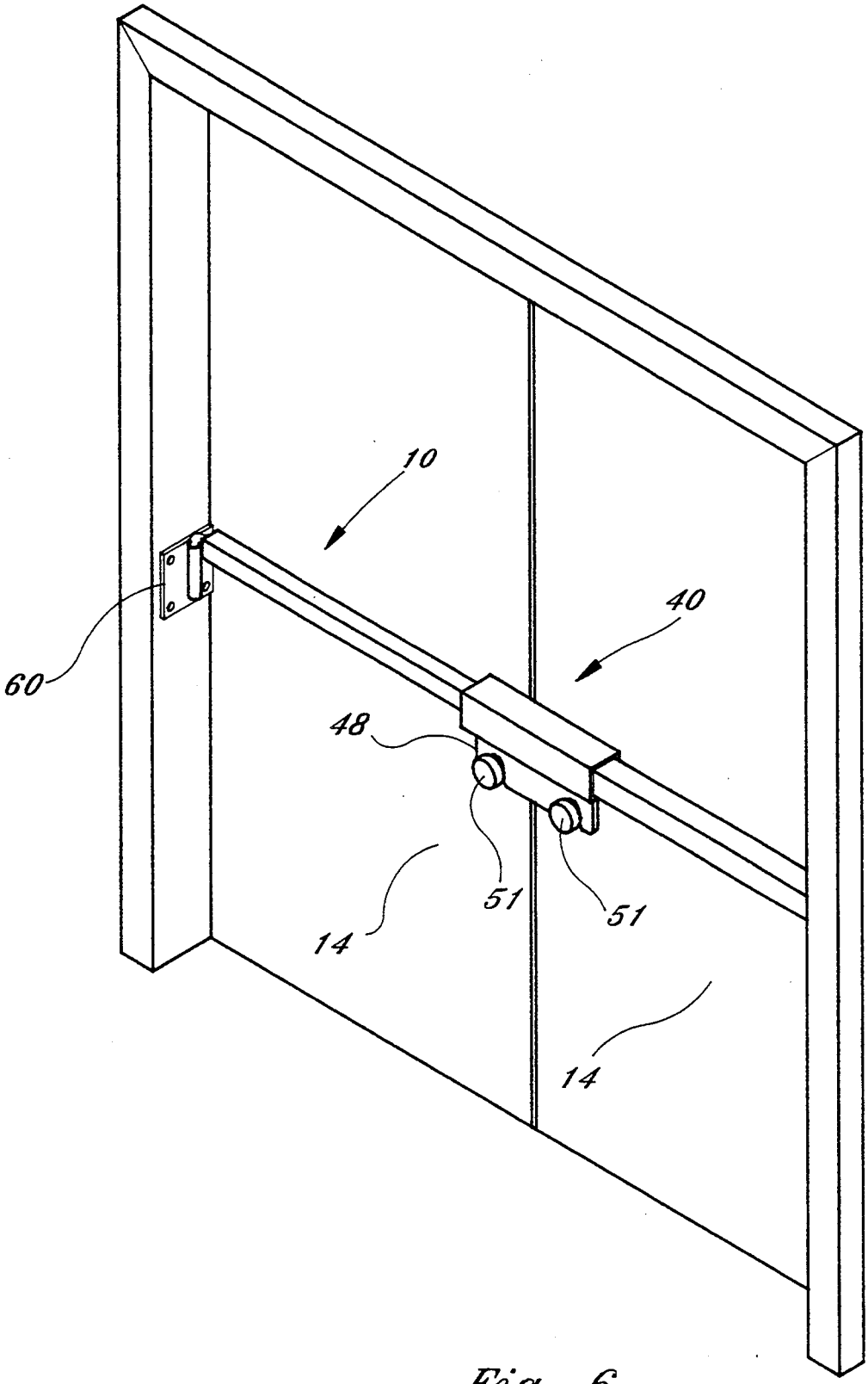
FIG. 6 is a perspective view of the security bar mounted on a pair of conventional, outward opening double doors.

FIG. 6 depicts said security bar 10 secured by mounting brackets 60 on a pair of outward opening double doors 14 such that said door knob retaining slide-bar 40 is properly positioned such that flange 48 engages the door knobs 51 as to prevent forcible outward opening of the doors 14. The invention contemplates similar procedures for use in securing inward or outward opening single doors.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A security bar system for preventing undesired forcible opening of hinged, inward opening doors comprising:

an elongated telescoping security bar having a first end and a second end, and comprised of at least two members, one member being longitudinally movable with respect to the other;

a pair of docking ferrules secured to by hinge pins to interior hinges on opposing sides of said doors, said docking ferrules each incorporating an aperture of sufficient dimension as to receive mounting dowels existing at each end of said security bar disposed therein thereby demountable coupling said security bar to said hinges such that said security bar remains fixed, extending horizontally across the doorway adjacent to said doors, thus securing the doors closed and preventing undesired forcible entry.

2. A security bar system for preventing undesired forcible opening of hinged, outward opening doors comprising:

an elongated telescoping security bar having a first end and a second end, and comprised of at least two members, one member being longitudinally movable with respect to the other;

a pair of mounting brackets, each incorporating a plurality of apertures through which suitable fasteners may be disposed for rigidly fixing said brackets to opposite sides of said interior door frame, each mounting bracket further incorporating a docking ferrule rigidly mounted, to said bracket, said docking ferrules each having an aperture of sufficient dimension as to receive mounting dowels existing at each end of said security bar disposed therein thereby demountable coupling said security bar to said door frame such that said security bar remains fixed, extending horizontally across the doorway adjacent to said doors;

means for engaging door knobs thereby securely retaining said door knobs adjacent to said security bar, thus preventing undesired forcible entry.

3. A security bar system as described in claim 2 wherein said means for engaging door knobs comprises:

a generally tubular elongated retaining member having an aperture extending therethrough, said aperture being of sufficient dimension as to accommodate said security bar disposed therein such that said retaining member is slidable along a portion of the length of said security bar thus enabling a user to position said retaining member at a position along said security bar, said member further incorporating a flange, rigidly fixed to and extending vertically downward from, said retaining member, said flange having a pair of generally parabolic notches disposed vertically downward to enable said flange to demountably couple said door knobs when lowered thereby securely retaining said door knobs adjacent to said security bar.

4. A security bar system as described in claim 3 wherein:

said retaining member incorporates a means for locking said retaining member in position.

5. A security bar system for use in securing hinged, inward opening doors to prevent undesired forcible entry comprising:

an elongated telescoping security bar having a first end and a second end, and comprised of at least two members, one member being longitudinally movable with respect to the other, each of said ends terminating in mounting dowels extending longitudinally from each end and substantially L-shaped as to further extend and terminate perpendicular to said longitudinal axis of said security bar;

a means for locking the security bar at a user selected length by anchoring the two members with respect to each other;

mounting adapters, secured to existing hinges on opposing sides of said doors, said mounting adapters secured to said hinges by hinge pins of an extended length, each mounting adapter incorporating a generally cylindrical docking ferrule in axial alignment with said hinge pins and having an aperture extending therethrough, said apertures of sufficient dimension as to receive said mounting dowels, existing at each end of said security bar, disposed therein thereby demountably coupling said security bar to said hinges such that said security bar remains fixed, extending horizontally across the doorway adjacent to said doors, thus preventing said doors from pivoting open inward.

6. A security bar system for use in securing hinged, outward opening doors to prevent undesired forcible opening, comprising:

an elongated telescoping security bar having a first end and a second end, and comprised of at least two members, one member being longitudinally movable with respect to the other such that the security bar is expandable and contractible, each of said ends terminating in mounting dowels extending longitudinally from said ends and substantially L-shaped as to further extend perpendicular to said longitudinal axis of said security bar;

a means for locking the security bar at a user selected length by anchoring the two members with respect to each other;

a means for mounting said security bar, whereby said mounting means comprises a pair of mounting brackets, each mounting bracket comprises a base plate having a plurality of generally circular apertures through which conventional fasteners may be disposed for rigidly fixing said mounting brackets to the interior side door jamb material, each mounting bracket further incorporates a generally cylindrical docking ferrule rigidly fixed to said base plate, said docking ferrules each having an aperture therethrough of sufficient dimension as to receive mounting dowels existing at each end of said security bar disposed therein;

a generally tubular elongated retaining member having a first end and a second end and having and aperture extending therethrough, said aperture being of sufficient dimension as to accommodate said security bar disposed therein such that said retaining member is slidable along a portion of the length of said security bar as to enable a user to position said retaining member along said security bar;

a flange rigidly fixed to said retaining member and extending vertically downward, said flange having a pair of generally parabolic notches disposed vertically downward to enable said flange to engage said door knobs when lowered, thereby securely retaining said door knobs adjacent to said security bar.

a means for locking the retaining member at a user selected position along the length of said security bar.

* * * * *